US009481105B2

(12) United States Patent
Easton et al.

(10) Patent No.: US 9,481,105 B2
(45) Date of Patent: Nov. 1, 2016

(54) SYSTEM, METHOD AND APPARATUS FOR FABRICATING ENVIRONMENTAL MASONRY UNITS

(71) Applicant: WATERSHED MATERIALS, LLC, Napa, CA (US)

(72) Inventors: David Carr Easton, Napa, CA (US); Khyber Easton, Wilseyville, CA (US)

(73) Assignee: WATERSHED MATERIALS, LLC, Napa, CA (US)

( * ) Notice: Subject to any disclaimer, the term of this patent is extended or adjusted under 35 U.S.C. 154(b) by 0 days.

(21) Appl. No.: 14/566,435

(22) Filed: Dec. 10, 2014

(65) Prior Publication Data

US 2015/0165645 A1 Jun. 18, 2015

Related U.S. Application Data

(60) Provisional application No. 61/915,167, filed on Dec. 12, 2013.

(51) Int. Cl.

| | |
|---|---|
| ***B28B 1/24*** | (2006.01) |
| ***B28B 3/02*** | (2006.01) |
| ***B28B 5/04*** | (2006.01) |
| ***B28B 17/00*** | (2006.01) |

(52) U.S. Cl.
CPC . *B28B 3/02* (2013.01); *B28B 5/04* (2013.01); *B28B 17/0063* (2013.01)

(58) Field of Classification Search
CPC ..... B28B 3/00; B28B 13/06; B28B 5/00; B28B 5/04; B28B 3/02; B28B 17/0063
See application file for complete search history.

(56) References Cited

U.S. PATENT DOCUMENTS

| | | | | |
|---|---|---|---|---|
| 1,327,721 | A | 1/1920 | Mattison, Jr. | |
| 2,121,450 | A | 6/1938 | Sentrop | |
| 2,341,012 | A | 2/1944 | Billman et al. | |
| 2,616,147 | A | 11/1952 | Dudley | |
| 2,706,320 | A | 4/1955 | Davies | |
| 3,081,509 | A | 3/1963 | Thornton | |
| 3,279,021 | A | 10/1966 | Pratt et al. | |
| 4,098,562 | A * | 7/1978 | Levin | B28B 5/04 425/121 |
| 4,802,836 | A | 2/1989 | Whissell | |
| 5,035,364 | A | 7/1991 | Escallon | |
| 5,062,610 | A | 11/1991 | Woolford et al. | |
| 5,392,998 | A * | 2/1995 | Suessegger | B02C 21/00 209/143 |

(Continued)

FOREIGN PATENT DOCUMENTS

WO 2011/127493 A1 10/2011

*Primary Examiner* — Galen Hauth
(74) *Attorney, Agent, or Firm* — Michael A. Glenn; Perkins Coie LLP

(57) ABSTRACT

Masonry units, such a blocks, are fabricated in a sequential process, using improved mold structures, such as within a production corridor of a corresponding fabrication system. A compressible masonry feedstock or formulated material, which can be de-agglomerated before use, is filled within a block mold having releasable elements. The feedstock or formulated material is then compressed within the mold structure. The compressed workpiece can be further processed, such as for any of final height adjustment, the establishment of a surface feature, or to remove cores. The block mold, having releasable elements or sides, such as using hinges or springs, is released from the formed block, wherein the formed masonry unit can be removed for curing, and wherein the block mold can be reused to fabricate a subsequent masonry unit.

34 Claims, 13 Drawing Sheets

(56) References Cited

U.S. PATENT DOCUMENTS

| | | | | |
|---|---|---|---|---|
| 5,697,563 | A | 12/1997 | Fujimoto et al. | |
| 5,699,969 | A | 12/1997 | Isaji | |
| 5,817,248 | A | 10/1998 | Forlini | |
| 6,039,277 | A | 3/2000 | Hamm et al. | |
| 6,113,379 | A | 9/2000 | LaCroix et al. | |
| 7,458,800 | B2 * | 12/2008 | Scherer et al. | 425/413 |
| 8,252,221 | B2 | 8/2012 | Davies et al. | |
| 2003/0113397 | A1 | 6/2003 | Bald | |
| 2003/0214069 | A1 | 11/2003 | Suto et al. | |
| 2006/0287197 | A1 * | 12/2006 | Maslanka | B01J 20/043 502/400 |
| 2009/0077920 | A1 | 3/2009 | Korman et al. | |
| 2010/0213640 | A1 * | 8/2010 | Piazzesi et al. | 264/333 |
| 2012/0139163 | A1 | 6/2012 | Garfinkel et al. | |
| 2012/0153526 | A1 * | 6/2012 | Ko et al. | 264/72 |

* cited by examiner

SYSTEM, METHOD AND APPARATUS FOR FABRICATING ENVIRONMENTAL MASONRY UNITS

CROSS REFERENCE TO RELATED APPLICATIONS

This application claims priority to U.S. Provisional Application No. 61/915,167, filed 12 Dec. 2013, which is incorporated herein in its entirety by this reference thereto.

FIELD OF THE INVENTION

At least one embodiment of the present invention pertains to the field of masonry product fabrication. More particularly, at least one embodiment pertains to fabrication structures, systems and methods for fabricating masonry building units using compressible masonry feedstocks.

BACKGROUND

Conventional concrete block machines are typically designed with internal molds that create cells or hollow portions of a concrete masonry unit (CMU). For such applications, a conventional mold array is not simply a series of rectangular mold boxes ganged together. Each mold box must contain the displacement molds that create the cells. This makes for expensive and heavy arrays, and also requires different arrays for each configuration of cells in a block. A full complement of mold arrays can cost tens of thousands of dollars.

In a conventional concrete block machine, each process or action occurs within the same section of the machine, which is commonly referred to as a throat. Conventional blocks are formed by pouring concrete into single or multiple molds, which have fixed dimensions and rigid sides. During the extraction of finished blocks from such molds, the molds are dragged off of the blocks, which can visually mar the cosmetic face of the block.

SUMMARY

Masonry units, such a blocks, are fabricated in a sequential process, using improved mold structures, such as within a production corridor of a corresponding fabrication system. A compressible masonry feedstock or formulated material, which can be de-agglomerated before use, is filled within a block mold having releasable elements. The feedstock or formulated material is then compressed within the mold structure. The compressed workpiece can be further processed, such as for any of final height adjustment, establishment of a surface feature, or to remove cores. The block mold, having releasable elements or sides, such as using hinges or springs, is released from the formed block, wherein the formed masonry unit can be removed for curing, and wherein the block mold can be reused to fabricate a subsequent masonry unit.

BRIEF DESCRIPTION OF THE DRAWINGS

One or more embodiments of the present invention are illustrated by way of example and not limitation in the figures of the accompanying drawings, in which like references indicate similar elements.

DETAILED DESCRIPTION

References in this description to "an embodiment", "one embodiment", or the like, mean that the particular feature, function, structure or characteristic being described is included in at least one embodiment of the present invention. Occurrences of such phrases in this specification do not necessarily all refer to the same embodiment. On the other hand, the embodiments referred to also are not necessarily mutually exclusive.

Introduced here is a process in which enhanced masonry units, such as masonry blocks, are sequentially fabricated, using block molds and a feedstock or formulated material that can be compressed. The block molds are releasable, which allows the masonry units to be fabricated with a wide variety of surfaces.

Also introduced here is a system that includes a production corridor, wherein the masonry blocks are formed and removed for curing. The compressible masonry feedstock can be de-agglomerated before being filled within a block mold. The feedstock is then compressed within the block mold, and can be further processed, such as for any of final height adjustment, the establishment of a surface feature, or to remove cell centers. The block mold is released from the formed block, whereby the formed masonry unit can be removed for curing, and whereby the block mold can be reused to fabricate a subsequent masonry unit.

In an illustrative embodiment of the masonry fabrication system, the system can be configured to move the workpiece and block mold through the system, such as from one compartment or station for one action to a subsequent compartment or station, for a subsequent action.

Figure 1:
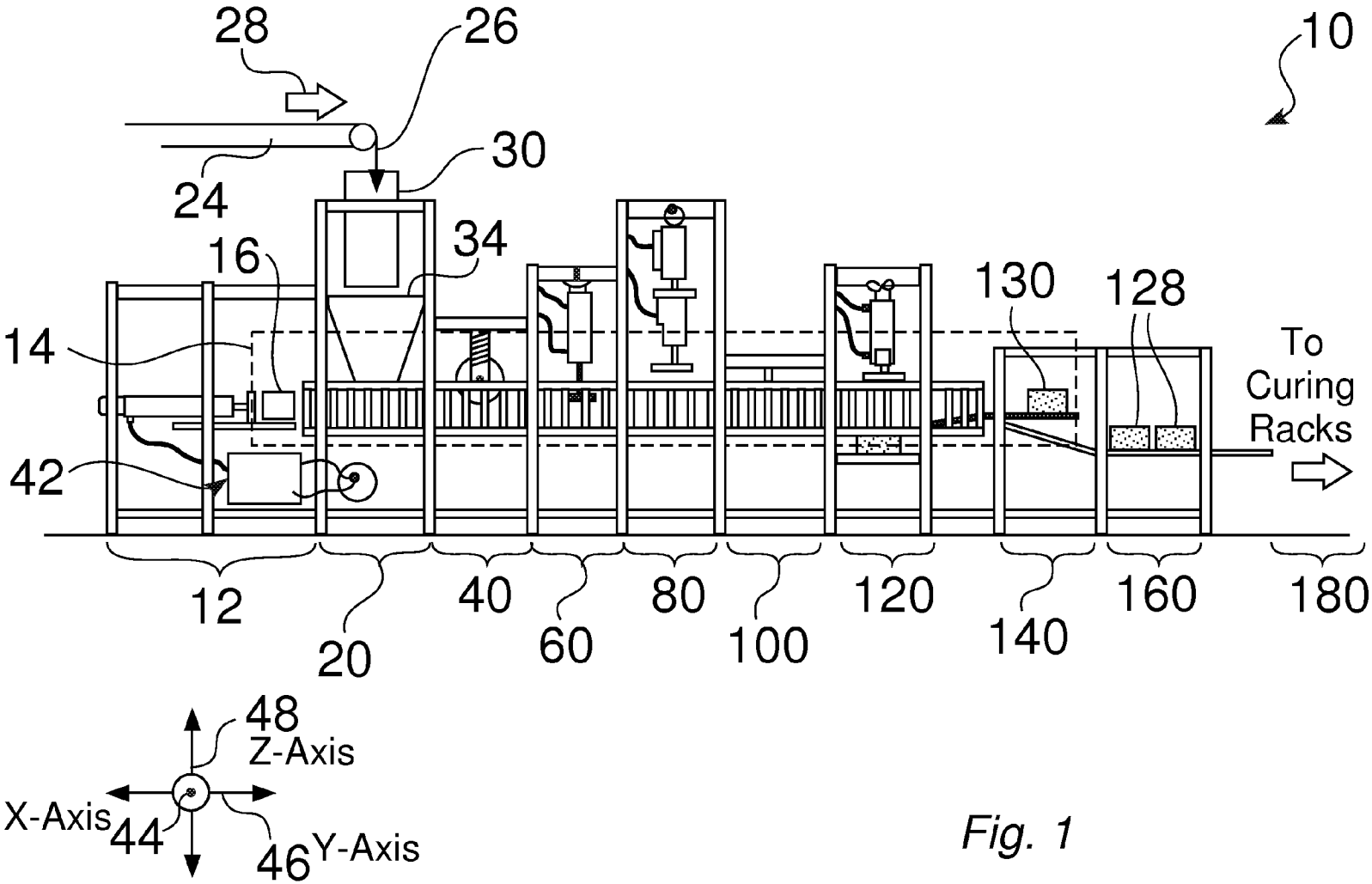
FIG. 1 shows an illustrative schematic view of an enhanced fabrication system for masonry products, which can include a plurality of linked stations.
Figure 2:
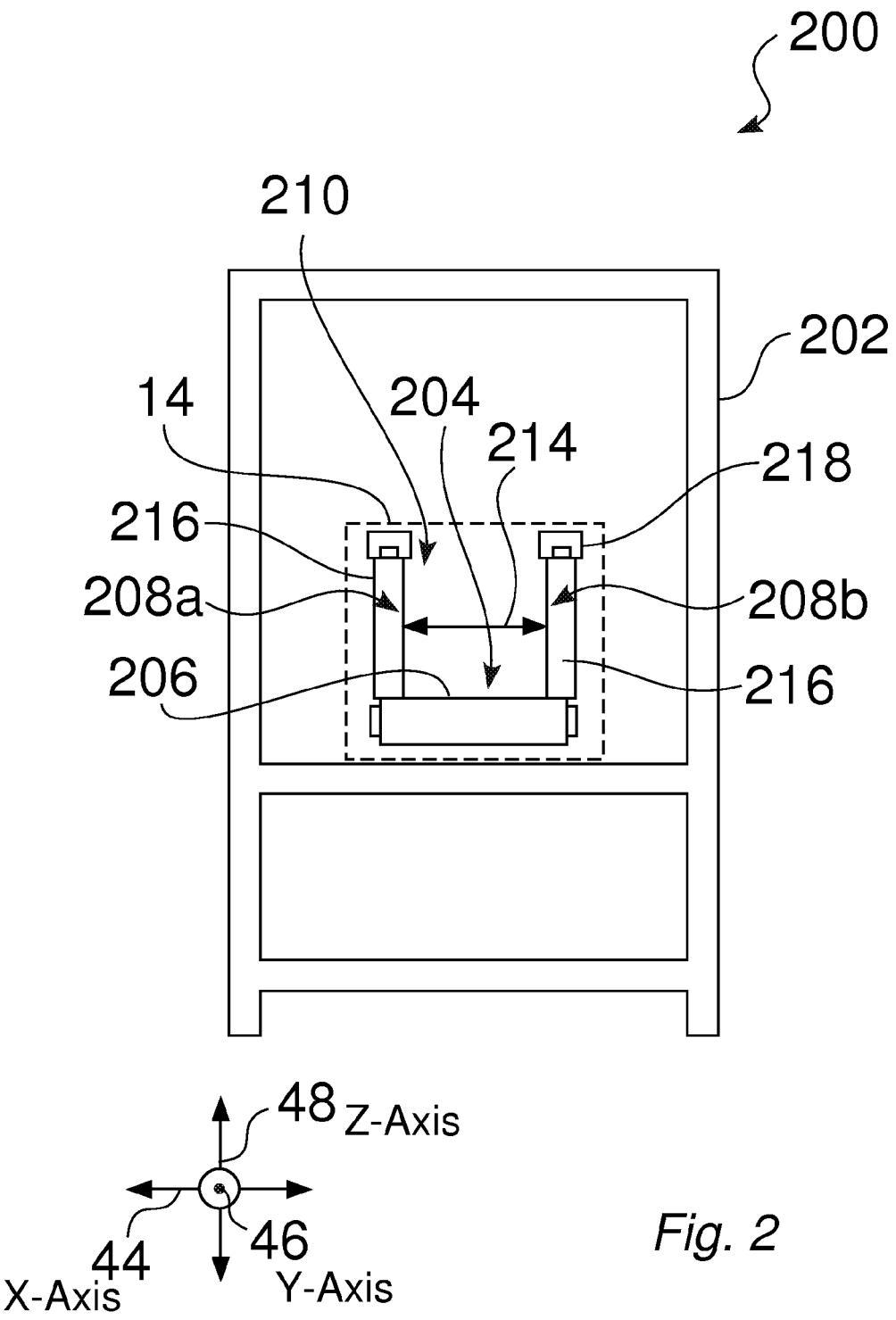
FIG. 2 is an illustrative schematic end view of an enhanced fabrication system for masonry products.
Figure 3:
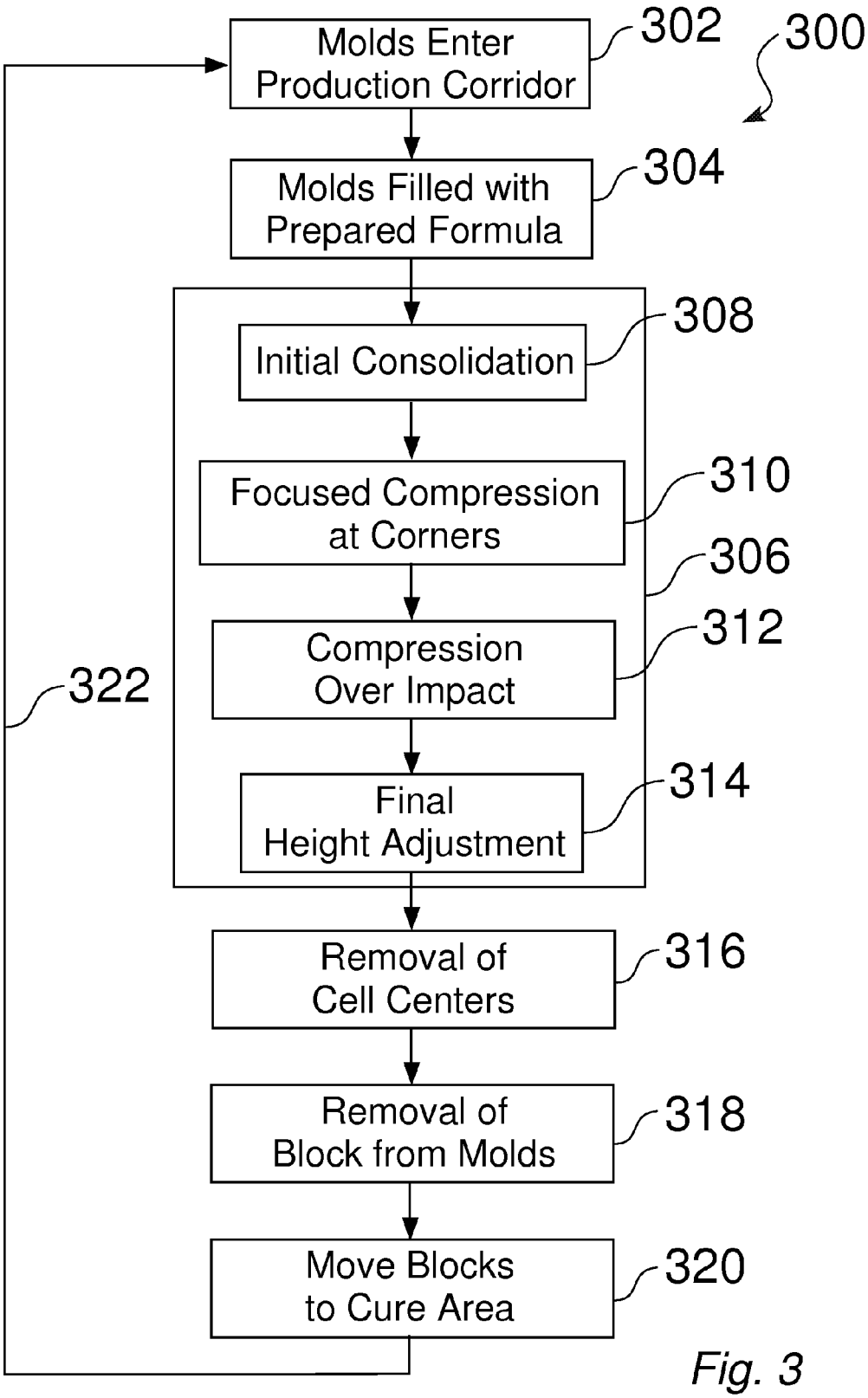
FIG. 3 shows an illustrative process for forming enhanced masonry blocks.

FIG. 1 shows an illustrative schematic view of an enhanced masonry unit fabrication system 10, which can include a plurality of linked stations, e.g. 12, 20, 40, 60, 80, 100, 120, 140, 160. FIG. 2 is an illustrative schematic end view 200 of an enhanced masonry unit fabrication system 10. FIG. 3 shows an illustrative process 300 for fabricating enhanced masonry blocks 128, such as within the masonry unit fabrication system 10 as seen in FIG. 1 and FIG. 2.

The illustrative masonry unit fabrication system 10 seen in FIG. 1 and FIG. 2 includes a central production corridor 14. In some system embodiments 10, the production corridor 14 defines a continuous horizontal chamber 14 with a flat bottom 204, parallel opposing sides 208*a* and 208*b*, and an open top 210. In some embodiments, the distance 214 between the parallel sides 208*a*,208*b* is variable.

As seen in FIG. 2, the bottom 204 of the central production corridor 14 can be stationary, or can include a moving belt 206 to assist in passage 512 (FIG. 5) of a block mold 16, e.g. such as with respect to a Y-Axis 46, through the production corridor 14.

The sides 208*a*, 208*b* can include a series of rollers 216 that are mounted to a roller frame 218, and oriented in the vertical direction, e.g. such as parallel with respect to a Z-Axis 48. The side rollers 216 and support frame 218 can provide lateral support necessary to resist deflection during compression, and restrain the sides 404*a*,404*b* (FIG. 4) of the block molds 16 until they are ready to be released for removal 318 (FIG. 3) of a fabricated masonry block 128.

The illustrative masonry unit fabrication system 10 seen in FIG. 1 can be mounted in a system frame 202, such as to allow for transportability. In the illustrative masonry unit fabrication system 10 shown in FIG. 1, various production stations or "activities" are mounted to the frame 202, wherein the stations are configured for any of filling or "charging" of one or more empty block molds 16 with feedstock 26, levelling, compressing, finishing, extracting cells, and de-molding, which make up the complete production sequence seen in FIG. 1.

Each of the production stations or activities can be fitted with various guides, rollers, chutes, gates, and other appurtenances, such as to facilitate the accuracy and quality of the finished masonry units 128.

FIG. 3 shows an illustrative process 300 for forming enhanced masonry units 128. A masonry block mold 16 enters 302 the production corridor 14, such as through a system entrance 12, and is then filled 304 with prepared feedstock 26, such as at a filling station 20.

A masonry block 128 is then dynamically formed 306, such as through a sequence comprising initial consolidation 308, e.g. at a consolidation station 40 (FIG. 7), focused compression 310 (FIG. 8) at corners 412 (FIG. 4) of the feedstock 26 within the masonry block molds 16, compression over impact 312 (FIG. 9), and in some embodiments, subsequent finishing 314 (FIG. 10), e.g. final height adjustment 314.

Figure 11:
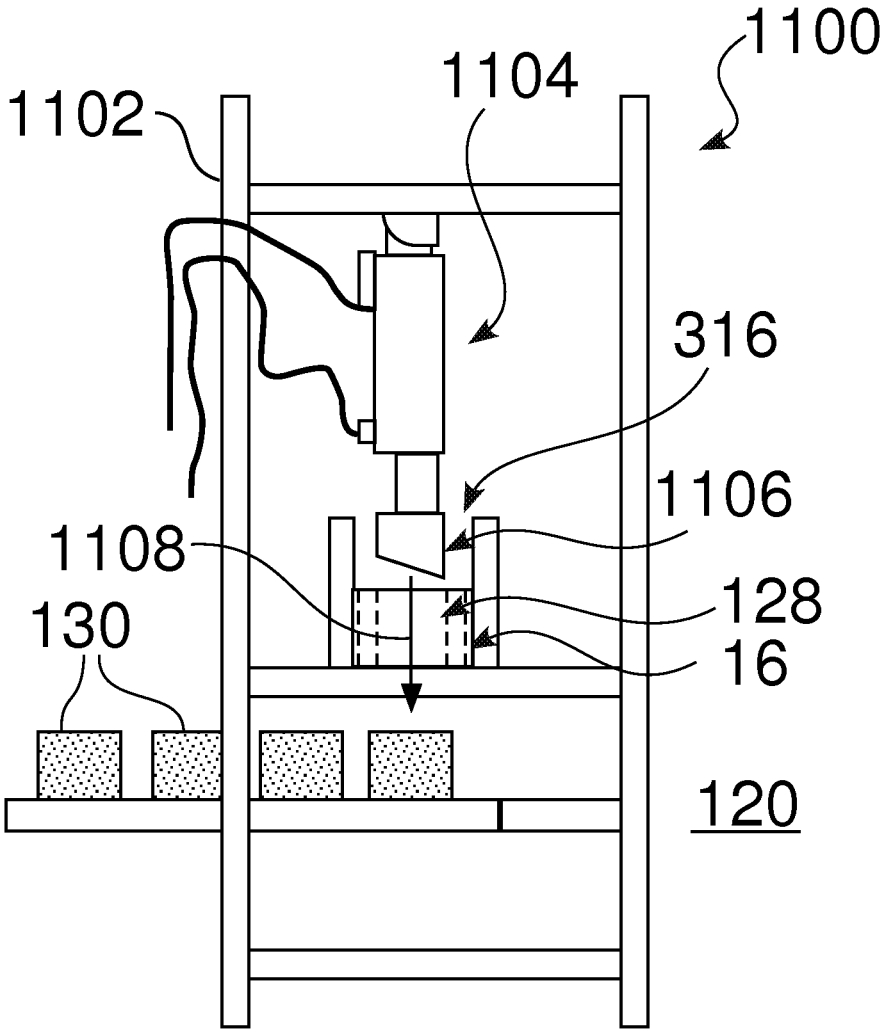
FIG. 11 is a schematic view of an illustrative masonry product fabrication station that is configured to remove cell centers from a formed enhanced masonry unit.

Once the masonry block 128 is formed 306, if cell centers 130 (FIG. 1, FIG. 11) are to be defined for the masonry block 128, the cell centers 130 can be removed 316 (FIG. 11).

The finished masonry block 128 is removed 318 (FIG. 12) from the mold 16, after which the masonry block 128 can be moved 320 (FIG. 13) to a curing area 180 (FIG. 1), e.g. curing racks 180, and the block mold 16 can be returned 322 for reentry into the production corridor 14.

Figure 4:
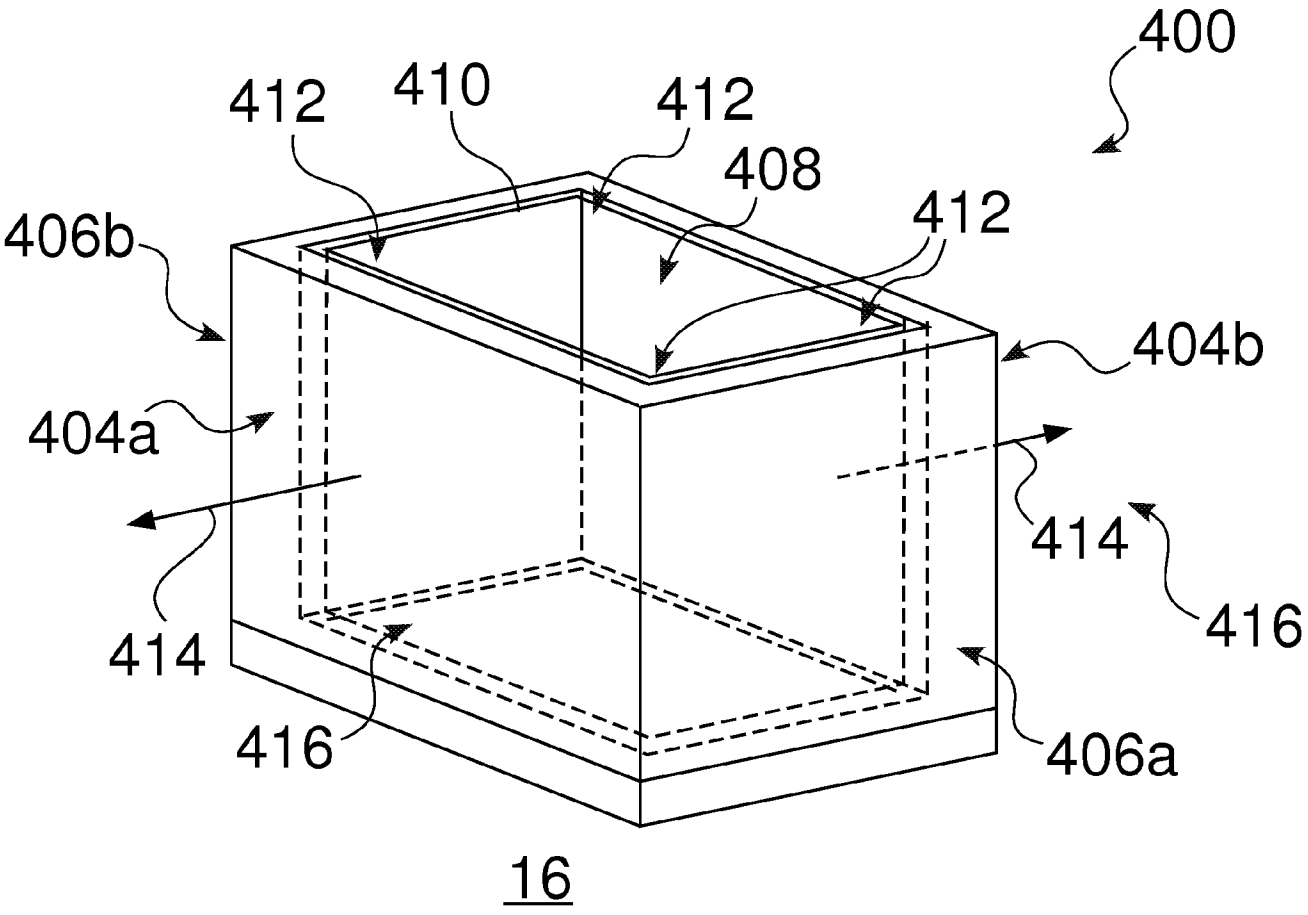
FIG. 4 is a schematic view of an illustrative block mold.

FIG. 4 is a schematic view 400 of an illustrative masonry block mold 16, which can be used within the masonry unit fabrication system 10 to fabricate the enhanced masonry blocks 128. The fabricated masonry units 128 are considered to be "architectural" in appearance, wherein the masonry units 128 are cast, e.g. 20, 40, 60, 80, 100), de-molded 120, and cured 180, with consideration for their eventual application.

The illustrative block mold 16 seen in FIG. 4 includes opposing left and right and sides 404*a* and 404*b*, and opposing front and back sides 406*a* and 406*b*, which together define an interior region 408 to be filled with the enhanced masonry feedstock 26.

The illustrative block mold 16 seen in FIG. 4 is releasable 416, and can be hinged and spring loaded, such as to allow the sides 404, e.g. 404*a*,404*b*, and/or ends 406, e.g. 406*a*, 406*b*, of the block mold 16 to release from the face of the masonry block 128, which can preserve the cosmetic character of the masonry block 128, and/or reduce the energy required to de-mold.

The illustrative block mold 16 seen in FIG. 4 can function as a containment vessel for one or more mold inserts, e.g. 410, such as to create a variety of shapes or sizes of masonry blocks 128. The use of inserts 410 within the block mold 16 can allow for quick and easy conversion from one dimension or face appearance to another. This is in sharp contrast to conventional concrete block machines, in which changing from one size or type of block requires considerable lost production time in switching out a mold array and a corresponding pressing plate, in addition to the need for re-alignment of guides and other moving parts.

In some embodiments of the masonry unit fabrication system 10, the exposed face of the masonry blocks 10 is created by the patterning on a side of the block mold 16, or on the mold inserts 410. For example, the block mold 16 or the mold inserts 410 can include patterning, such as to produce masonry building units 128 having any of embossing, de-bossing, signatures, brands, or any other random or geometric pattern, as rough or smooth as desired by the client, designer, or architect.

The following discussion describes illustrative operations for stations or activities in the enhanced masonry product fabrication process.

Figure 5:
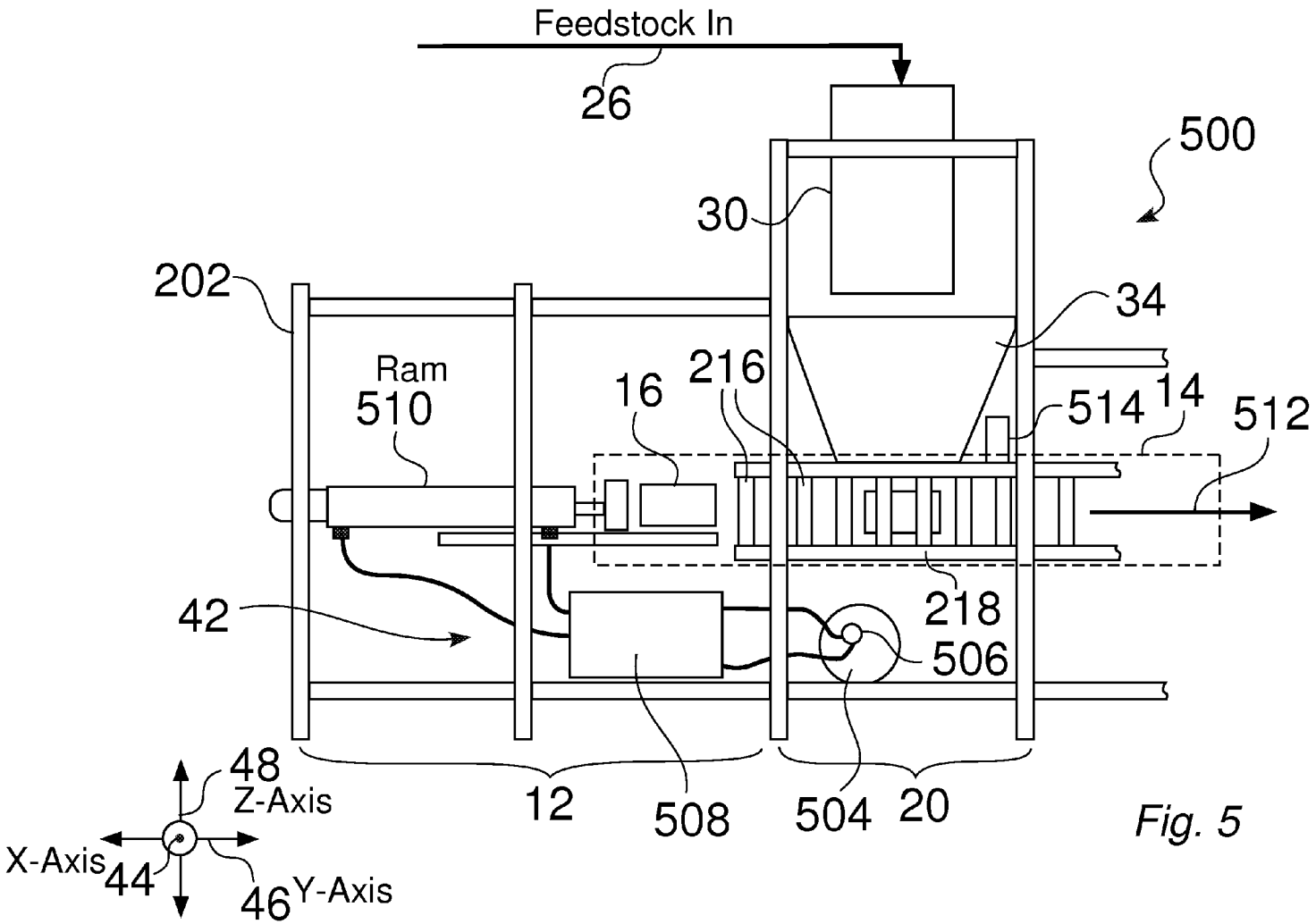
FIG. 5 is a schematic view of an illustrative masonry product fabrication station that is configured to receive an enhanced masonry block mold.

FIG. 5 is a schematic view 500 of an illustrative masonry product fabrication station 12 that is configured to receive enhanced masonry block molds 16, such as for entry into the production corridor 14 of the masonry unit fabrication system 10. In the illustrative station 12 seen in FIG. 5, movement of a masonry block mold 16 can be assisted by a ram 510, such as connected to a hydraulic system 42 that includes a motor 504, a pump 506, and an oil reservoir 508. The illustrative block mold 16 seen in FIG. 5 is configured to be moved 512 through the production corridor 14, and can be guided, such as by rollers 216 and an associated frame 218.

Figure 6:
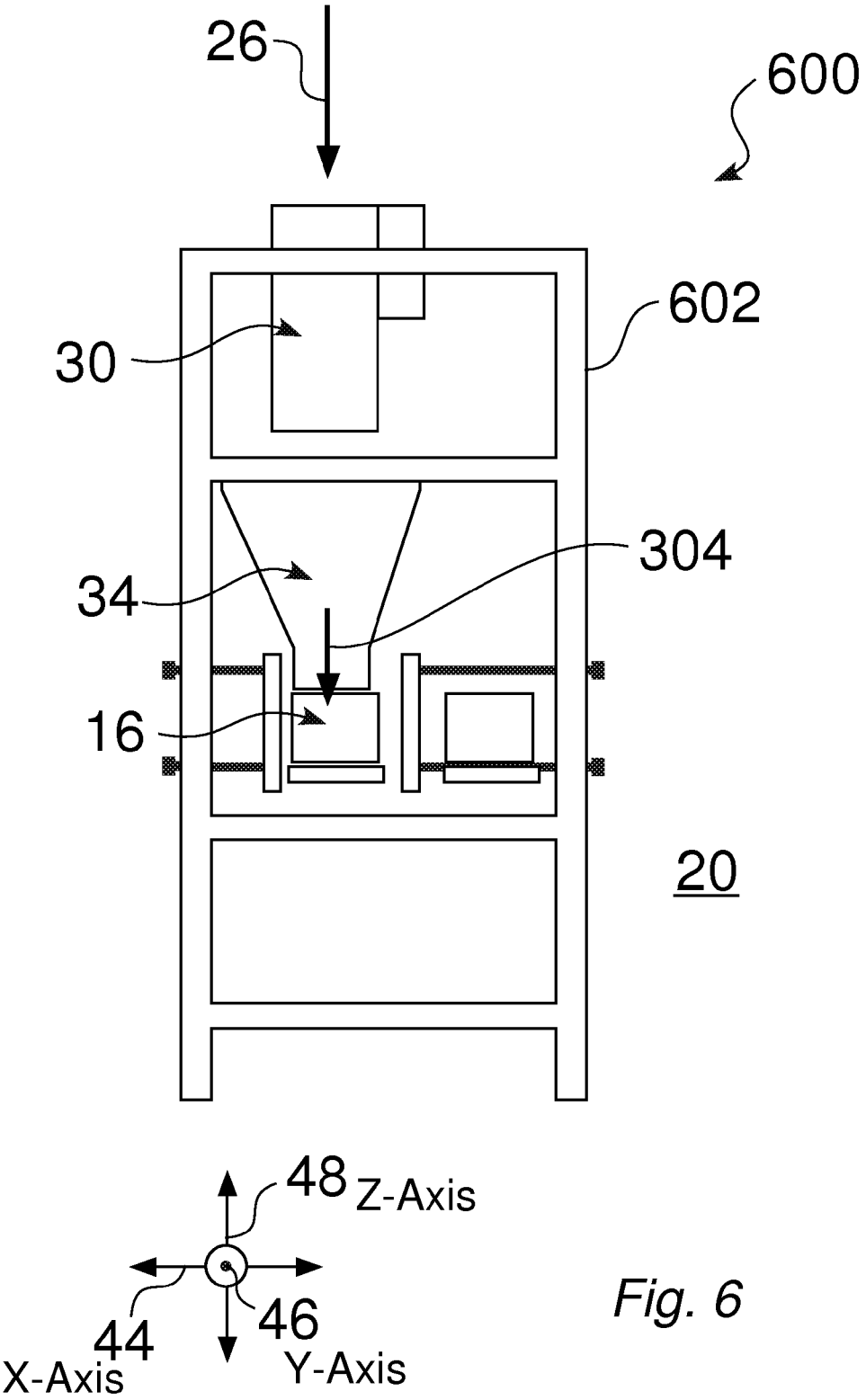
FIG. 6 is a schematic view of an illustrative masonry product fabrication station that is configured to fill an enhanced masonry block mold a prepared feedstock.

FIG. 5 also shows a schematic side view of an illustrative filling station 20 that is configured to receive a masonry block mold 16 through the production corridor 14, and fill 304 the masonry block mold 16 with a prepared feedstock 26. FIG. 6 is a schematic end view 600 of an illustrative filling station 20, which can include a corresponding frame 602, wherein the frame 602 can be a portion of the system frame 202 (FIG. 2). In the illustrative filling station 20 seen in FIG. 5 and FIG. 6, feedstock 26 is delivered 28 to the station 20 by a feedstock transport mechanism 24, such as comprising a processed material delivery conveyor 24. The masonry unit fabrication system 10 can further comprise a de-agglomerator 30 between the feedstock transport mechanism 24 and the supply hopper 34. In some system embodiments 10, the de-agglomerator 30 can be integrated with the filling station.

The illustrative de-agglomerator 30 seen in FIG. 5 and FIG. 6, which can be a vertical shaft de-agglomerating tertiary mixer 30, is located between the processed material delivery conveyor 24 and the supply hopper 34. The de-agglomerator 30 can be configured to break apart any clay or binder "pills" within a delivered feedstock 26, such as to maximize the distribution of small particle constituents within an aggregate matrix for the feedstock 26. Although the mechanism of the de-agglomerator 30 is familiar to mechanical engineers and machine designers for other applications, the implementation and result within the masonry unit fabrication system 10 is significantly different than techniques used in the fabrication of conventional compressed building units.

In operation, when an empty and relatively light block mold 16 passes under a fully stocked and stationary hopper 34, the block mold 16 is filled or "charged" with the masonry feedstock 26. As the filled block mold 16 exits the filling station 20, the filled block mold 16 can pass under an adjustable departure "gate" 514, to be struck off or level to an appropriate loose depth. Some of the advantages to this method of charging empty molds 16 are a rapid filling time and a simplicity of action. The hopper 34 is stationary with respect to the filling station 20, which is also stationary. In some embodiments, the hopper 34 has no moving parts to bind up or become clogged with loose material, and no mechanical action to power or to service.

The adjustable departure gate 514 can provide precise control over the charging volume of the feedstock 26, and can be configured to prevent loose material 26 to escape onto other working parts of the production corridor 14. As feedstocks 26 and moisture contents vary, the compaction factor also varies, which can readily be controlled by the masonry unit fabrication system 10. For example, the adjustable departure gate 514 can provide a point of control, to assure that each block mold 16 is filled to the correct height for eventual desired compression.

In contrast to the filling station 20 disclosed herein, a mold array in a conventional block machine is typically filled by a supply hopper that is required to travel, such as on rails. The process begins with the hopper in a waiting position, out of the machine throat. The hopper travels on the rails and passes over an empty mold array, filling the molds as it travels. The hopper then retracts along the rails, scraping off excess loose material as it returns to the waiting position out of the throat. A fully loaded hopper is heavy, and must be supported on rollers and guide rails and powered by gears or hydraulics.

Figure 7:
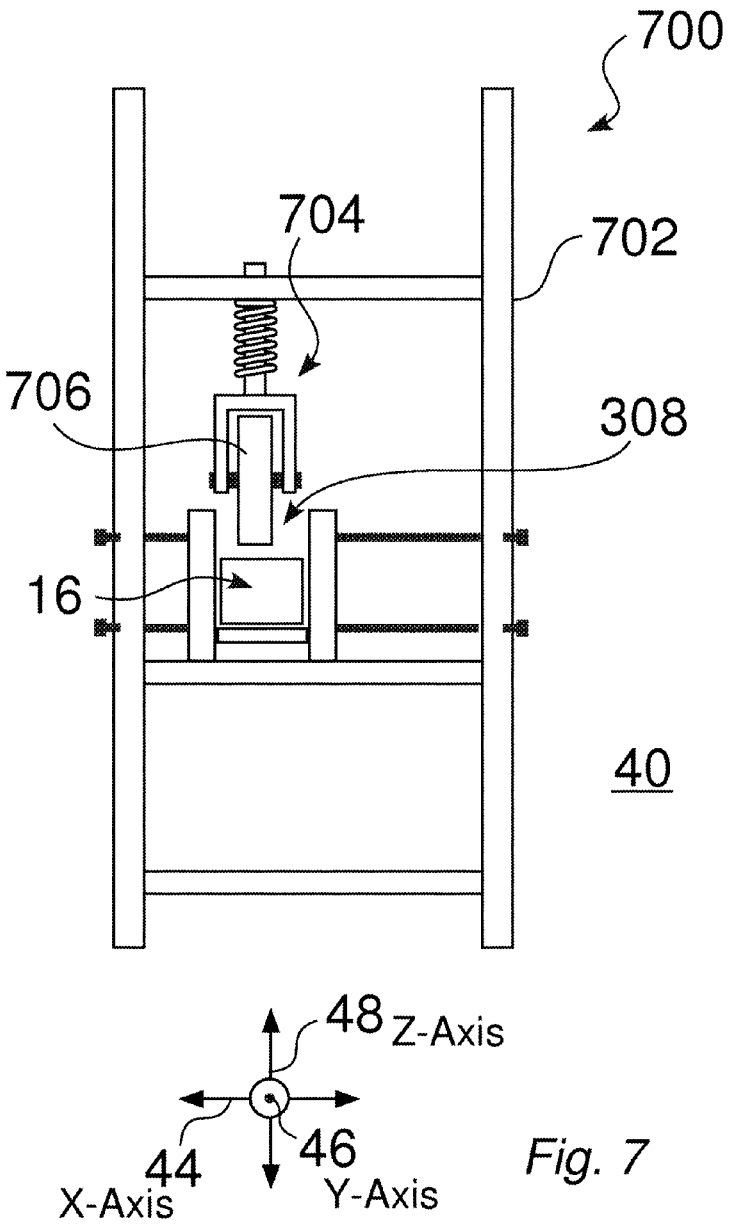
FIG. 7 is a schematic view of an illustrative masonry product fabrication station that is configured to consolidate the feedstock within an enhanced masonry block mold.

FIG. 7 is a schematic view 700 of an illustrative masonry product fabrication station 40 that is configured to consolidate 308 the feedstock 26 within the block molds 16. The illustrative consolidation station 40 seen in FIG. 7 includes a pressure wheel assembly 704 mounted to a corresponding frame 702, wherein the frame 702 can be a portion of the system frame 202 (FIG. 2). The illustrative pressure wheel assembly 704 seen in FIG. 7 includes one or more weighted rollers 706.

Figure 9:
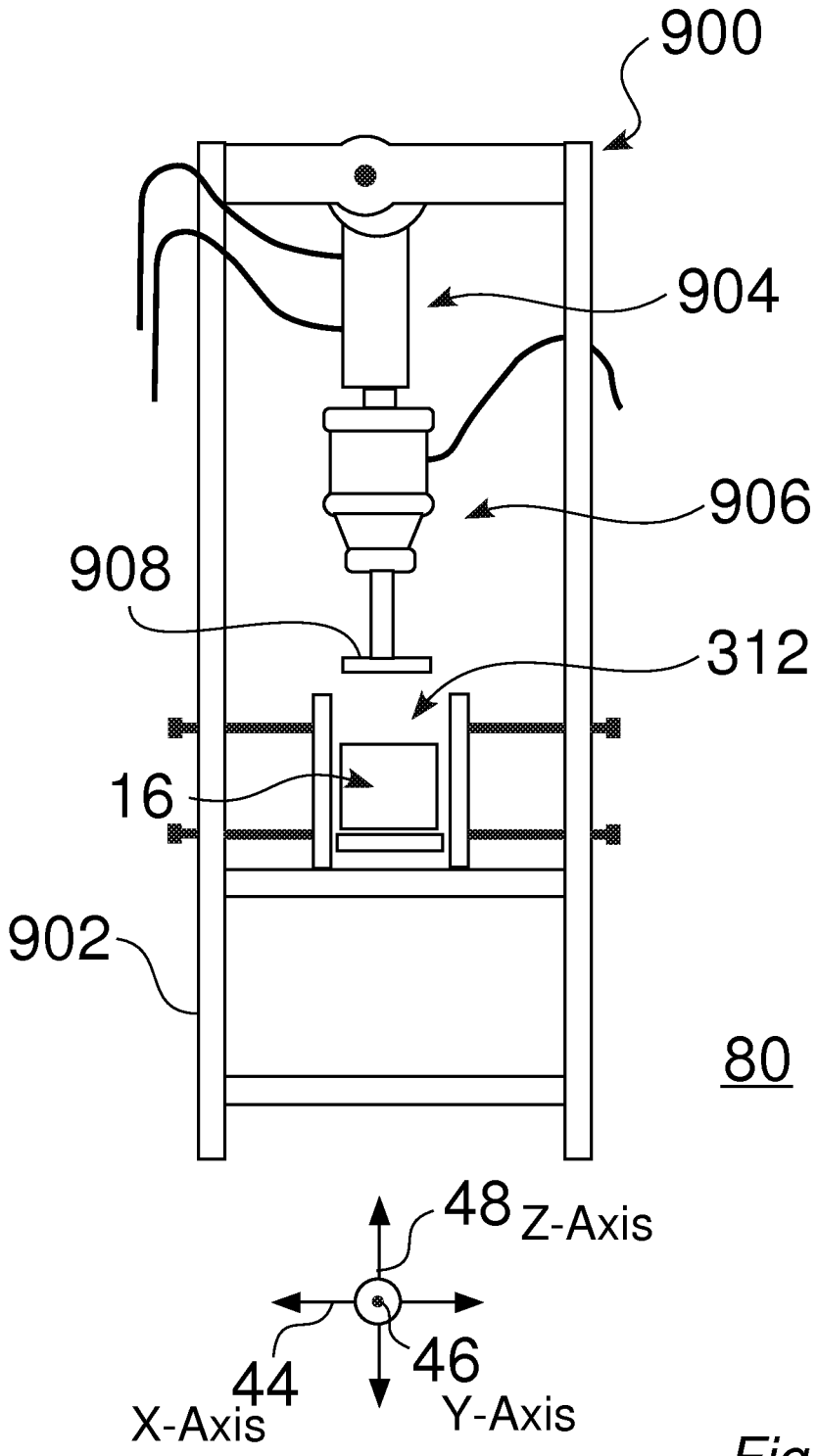
FIG. 9 is a schematic view of an illustrative masonry product fabrication station that is configured to provide compression over impact for a feedstock within an enhanced masonry block mold.

The masonry unit fabrication system 10 can be configured to pass a charged block mold 16 under the weighted rollers 706, which can be configured to consolidate the loose material 26, and can reduce the energy required in a subsequent impact stage, e.g. at station 80 (FIG. 9). In some system embodiments 10, the diameter and/or downward pressure from the rollers 706 can be adjusted in response to different characteristics of the loose material 26, such as water content and/or an aggregate packing index value.

Figure 8:
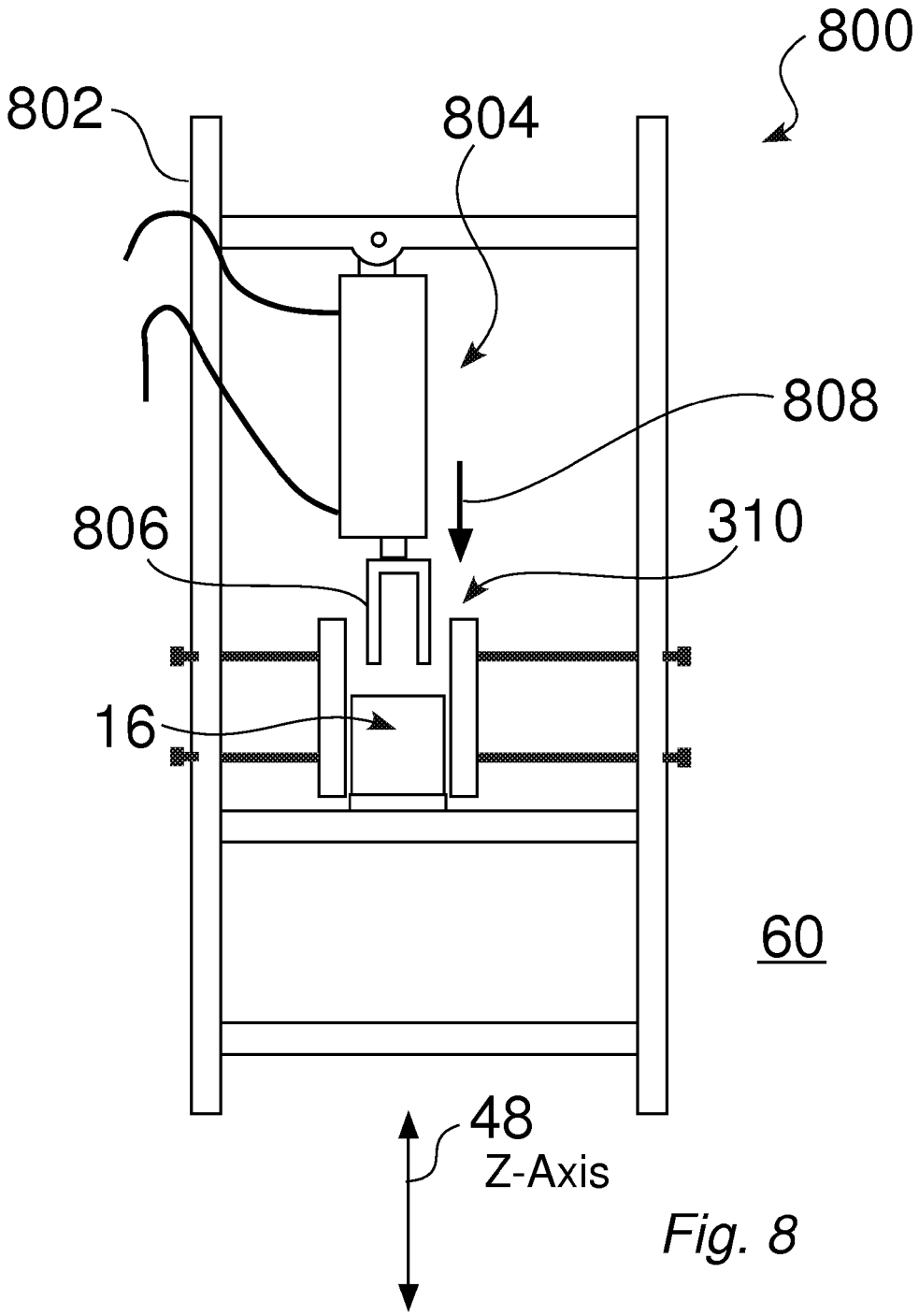
FIG. 8 is a schematic view of an illustrative masonry product fabrication station that is configured to provide focused compression of the feedstock within an enhanced masonry block mold, such as for each of the corners of an enhanced masonry block mold.

FIG. 8 is a schematic view 800 of an illustrative masonry product fabrication station 60 that is configured to provide focused compression 310 of the feedstock within a block mold 16, such as at each of the corners 412 (FIG. 4) of a block mold 16. The illustrative fabrication station 60 seen in FIG. 8 includes a focused compression ram 804, mounted to a corresponding frame 802, wherein the frame 802 can be a portion of the system frame 202 (FIG. 2). The compression ram 804 can provide a compression or stabbing force vertically downward 808 with a focused compression tool 806, such as with respect to a Z-Axis 48.

In operation, such as upon leaving an initial consolidation station 40, the charged block mold 16 is moved into a subsequent section 60 of the production corridor 14 where a hydraulic cylinder or ram 804 can force an assembly 806 of four fingers or stabs downward 808, into the semi-loose masonry feedstock 26, at each of the four corners 412 of the block mold 16. This action can force larger particles in the feedstock 26 away from the corners 412, such as to achieve strong, dense edges in the finished masonry unit 128. The controlled compression 310 of a masonry feedstock 26 within a block mold 16 can result in a significant improvement in edge quality.

FIG. 9 is a schematic view 900 of an illustrative masonry product fabrication station 80 that is configured to provide dynamic compression 312, which includes compression over impact, for masonry feedstock 26 within a block mold 16. The fabrication station 80 can include a corresponding frame 902, wherein the frame 902 can be a portion of the system frame 202 (FIG. 2).

In a conventional concrete block machine, consolidation of loose material is typically accomplished with a hydraulically powered presser plate that is configured to descend onto a mold array, while vibratory force is applied to the entire array. The presser plate matches the outside dimensions of the mold array, and has cut-outs to match the internal cells of the hollow blocks, such as to correspond to concrete masonry unit (CMU) configurations. The diameter, power requirements, and guide rods of the hydraulic cylinder and presser plate must be sized to maintain alignment over the entire array dimensions, and to transmit the required force. Changing the machine to produce blocks of a different size or different cell configuration requires considerable lost production time and complicated procedures.

In contrast to such conventional techniques, consolidation of the loose masonry feedstock 26 in the masonry unit fabrication system 10 can be accomplished with dynamic compression 312, which includes high-frequency impact 906, supported by hydraulic pressure 904, and can be applied to one block mold 16 at a time.

In contrast to conventional techniques, the hydraulic cylinder or ram 904 is smaller in diameter, the power requirement is less, the presser plate is a fraction of the size, the guide rod mechanism is lighter and simpler. The components are therefore configured to experience less down time and require less maintenance. Additionally, being smaller, hardware associated with the station 80 is faster and less expensive to replace should any part break or wear out.

The illustrative dynamic compression station 80 seen in FIG. 9 can be configured to use the separate yet combined forces of both impact 906 and compression 904, thereby imparting an unparalleled degree of control over the ultimate density of the enhanced masonry blocks 128.

For example, in some system embodiments 10, the dynamic compression station 80 can be configured to control the applied dynamic compression 312, to produce a range of enhanced masonry blocks 128, e.g. ultra-lightweight through heavyweight units, with little adjustment to the equipment. Some embodiments of the dynamic compression station 80 include control mechanisms that are built into the machine 80, which can govern duration of impact, compression force, and/or time of overlap.

The enhanced masonry fabrication system 10 can be flexibly configured for any of a variety of block mold configurations 16, charging depth of the block molds 16, and a virtually unlimited range of feedstocks 26, wherein each can dictate a different force and impact configuration. The dynamic compression station 80 is readily adapted for these different parameters.

A significant advantage of the dynamic compression station 80 is that the presser plate or "foot" of the impact tool 908 can be completely interchangeable, which allows rapid conversion from one dimension or block shape to another. The shape of the impact foot 908 can directly correspond to the shape of the block mold 16 and any mold inserts 410, which allows for switching from one product fabrication process 300 to another in a fraction of the time typical for conventional concrete block machines. Switching from one product shape is as rapid and trouble free as switching feedstocks 26 from cement and aggregate to clay and straw. The formulations of the final unit product 128 are limitless.

Figure 10:
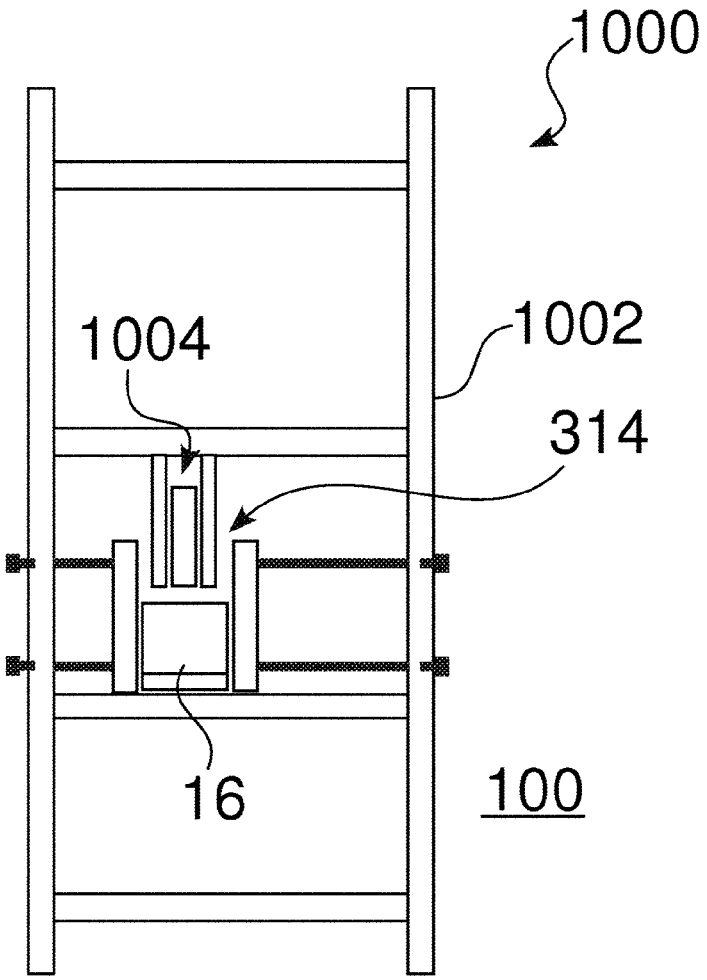
FIG. 10 is a schematic view of an illustrative masonry product fabrication station that is configured to provide final height adjustment for feedstock within an enhanced masonry block mold.

FIG. 10 is a schematic view 1000 of an illustrative post-production finishing station 100, which can include one or more "facing" components that are configured to act upon the top of the formed masonry block 128. In some embodiments of the illustrative post-production finishing station 100, the facing components can include any of a vertically aligned rotating cylinder fitted with brushes, a wheel fitted with diamond grinding teeth, raking tools, a sand or bead blaster, a water spray bath, or other surface abrasion, washing, or weathering components. The point is that while the fresh masonry units 128 are still on the production line 14, with their surfaces fragile and susceptible to easy deformation, the effort and/or energy required to affect the desired alterations is lowest. Furthermore, keeping units on one production line from start to finish requires the least amount of handling and thus the most efficient use of energy and manpower.

Some embodiments of the illustrative post-production finishing station 100 can be configured to provide final height adjustment 314 of the feedstock 26 within the block molds 16, such as with a blade assembly 1004 mounted to a corresponding station frame 1002, wherein the station frame 1002 can be a portion of the system frame 202 (FIG. 2).

While the post-production finishing station 100 is not necessary for fabrication 300 of all masonry blocks 128, the benefit of the illustrative finishing station 100 seen in FIG. 10 is that it can be available if necessary, such as to shave the top of a block or unit 128 to maintain a precise height dimension.

In some embodiments of the masonry unit fabrication system 10 and associated process 300, the intended exposed face of the building unit 128 can be the top of the masonry block 128, rather than one or more of the sides of the masonry block 128.

The tops of concrete blocks made in conventional block machines have only one type of finish.

In contrast to such conventional techniques, the illustrative finishing station 100 seen in FIG. 10 can be configured for a wide variety of block finishes and/or surfaces. For example, while still in the mold box 16 and traveling along the production corridor 14, the fully consolidated masonry units 128 can pass beneath a rotating cylinder 1004, upon which can be mounted any of shaving blades, buffing wheels, wire wheels, polishing stones, or other mechanisms to affect the still-fragile top surface of the formed masonry block 128 in a desired manner.

FIG. 11 is a schematic view 1100 of an illustrative masonry product fabrication station 120 that is configured to remove cell centers 130, if required, such as for masonry blocks 128 that have one or more hollow cores defined therethrough.

The masonry unit fabrication system 10 can be configured to produce blocks 128 of varying dimensions, and can easily be switched from one dimension to another. In some system embodiments 10, the extrusion 316 of cell centers 130, rather than casting them, allows for greater flexibility and lower cost.

The illustrative station 120 seen in FIG. 11 includes a ram 1104 mounted to a corresponding station frame 1102, wherein the station frame 1102 can be a portion of the system frame 202 (FIG. 2). A punch 1106 connected to the ram 1104 can be controlled to remove or extract a cell center 130 from a formed masonry block 128.

Conventional concrete block machines are typically designed with internal molds that create cells or hollow portions of a CMU block. For such applications, a conventional mold array is not simply a series of rectangular mold boxes ganged together. Each mold box must contain the displacement molds that create the cells. This makes for expensive and heavy arrays, and also requires different arrays for each configuration of cells in a block. A full complement of mold arrays can cost tens of thousands of dollars.

The illustrative block mold 16, such as seen in FIG. 4, can take a different approach to the creation of cells within a hollow block 128. In the illustrative block mold embodiment 16 shown in FIG. 4, the cells 130 are not cast into the block 128, but are instead extruded 316 out of the block 128, as shown in FIG. 11.

Unlike a full mold array typical for a conventional block machine, in which every mold box can often contain two cell molds, the illustrative station 120 seen in FIG. 11 can be implemented with one pair of cell cutters 1106, which can comprise a cutter or punch assembly, rather than rigid molds.

In further contrast to a conventional block machine, in which changes in block or cell configuration requires a complete change-out of a mold array and presser plates, the illustrative station 120 seen in FIG. 11 only requires switching a single pair of cutters 1106, and no change to the block molds 16.

In operation, while traveling along the production corridor 14, such as between finishing 314 and de-molding 318 (FIG. 12), the fully consolidated blocks 128, still jacketed in the mold boxes 16, pass into the cell extraction station 120. Steel cutters 1106, such as having the shape and dimensions of the desired cell centers 130, are hydraulically forced downward 1108 through the block 128, much like holes are extracted from a doughnut.

In some embodiments, the portion of the feedstock 26 that is removed by the cutters 1106 can define a smaller block 130, which in some embodiments can be used for value-added products. For example, in some system embodiments 10, such removed portions 130 can subsequently be diverted onto a secondary production line. In some embodiments, the removed portions 130 can be sliced, such as into wafers of varying widths, to become any of paving stones, veneer bricks, floor tiles, wall tiles, or other building products.

Figure 12:
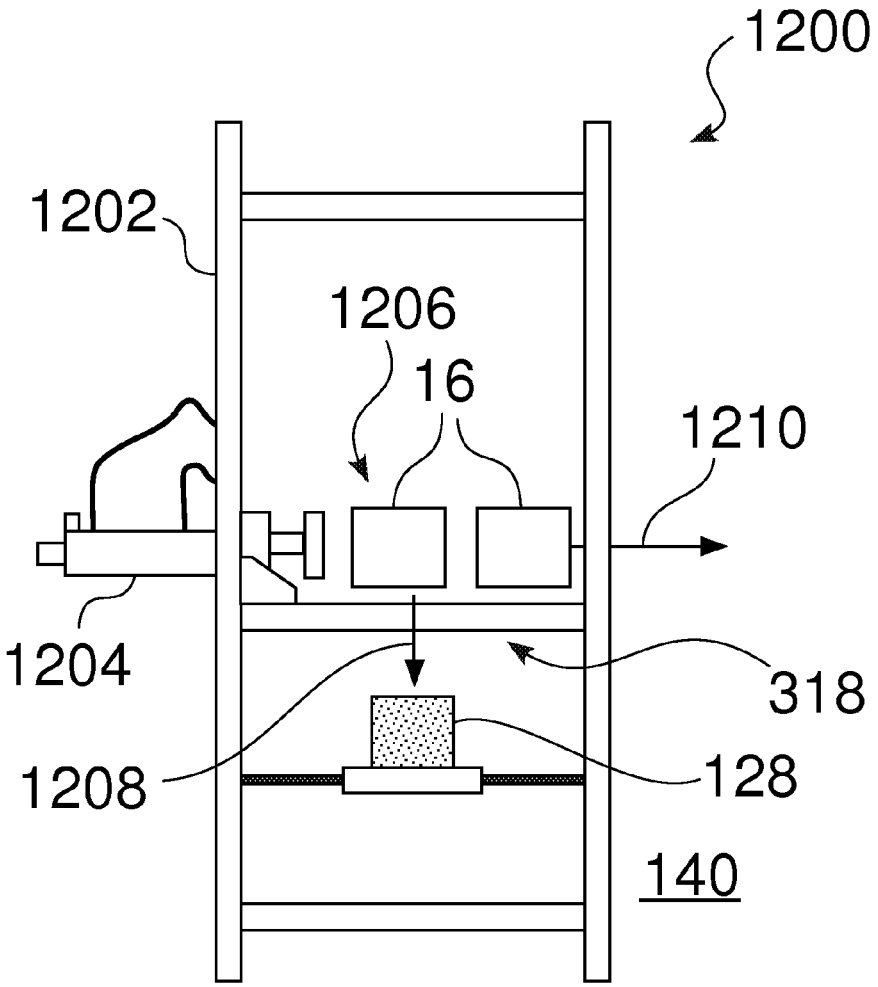
FIG. 12 is a schematic view of an illustrative masonry product fabrication station that is configured to open a block mold to release a formed masonry unit.

FIG. 12 is a schematic view 1200 of an illustrative masonry product removal station 140 that is configured to open 1206 a block mold 16, wherein the block mold 16 can open outward 414, to remove, i.e. de-mold 318 a formed masonry block 128. In the illustrative fabrication station 140 seen in FIG. 12, the released blocks 128 are configured to move downward 1208. The emptied block mold 16 can then be moved 1210, such as by a block mold ram 1204 that is mounted on the station frame 1202, which can be a portion of the system frame 202 (FIG. 2).

In a conventional concrete block machine, freshly-consolidated blocks or building units rest on the casting tray while the mold array is lifted upward and off the blocks. The steel walls of the individual molds drag across the face of the blocks as the array moves upward, which can mar the surface. This conventional technique eliminates any opportunity for creating a decorative block face, without an additional surfacing process, such as by splitting, grinding, and/or washing.

In contrast to such conventional block forming techniques, which can result in an undesirable smeared face appearance of concrete blocks, the enhanced block molds 16, as disclosed herein, can be configured to pull the block mold away 414 (FIG. 4) from the face of the freshly-consolidated masonry blocks or building units 128. This also allows unique and desirable visual characteristics to be imparted on the dynamically compressed masonry blocks 128, wherein key aesthetic features can readily be defined on the face of the masonry blocks or building units 128.

As well, for an enhanced block mold 16 that is configured to pull away 414 from the face of the formed block 128, one or more mold inserts 410 can be added to the interior 408 of the block mold 16, such as to cast a virtually unlimited range of surface patterning into the face of the masonry block 128. Such design freedom allows an architect or purchaser to design a unique and specific block or unit signature.

All masonry units are fragile and susceptible to damage when young. For this reason, delicate handling is a prerequisite of any production system. Conventional concrete block machines mold multiple blocks directly onto large trays, which are then moved via forklift or specially designed conveyance into a heated curing chamber. The trays, special conveyance equipment, and curing chambers are vastly expensive.

Figure 13:
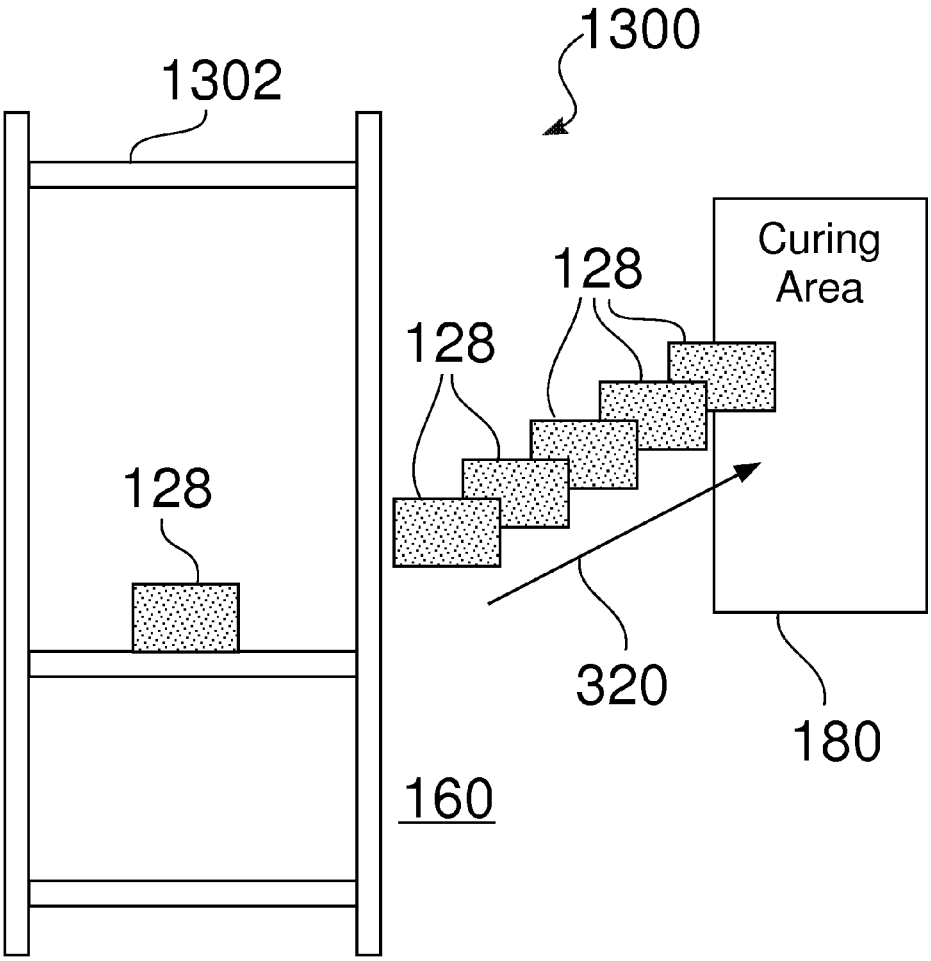
FIG. 13 is a schematic view of an illustrative masonry product fabrication station that is configured for removal of enhanced masonry units, for subsequent curing, and for the return of an enhanced masonry block mold for subsequent fabrication.

FIG. 13 is a schematic view 1300 of an illustrative masonry product fabrication station 160 that is configured for removal 320 of blocks 128 to a curing area 180, which can include a corresponding frame 1302, which can be a portion of the system frame 202 (FIG. 2).

In the illustrative masonry unit fabrication system 10 seen in FIG. 1 and FIG. 2, the fabricated masonry blocks 128 can be controllably moved 512 through the production corridor 14, such as beyond the removal station 140, which can keep the masonry blocks 128 untouched during their initial "set". After the masonry blocks 128 have attained adequate strength, they can be removed 320 from the production corridor 14 and stacked in a curing area, rack or pallet 180, for a slow, moist, proper cure. This extension of the production corridor 14 eliminates cumbersome aspects of conventional block production equipment, and can reduce handling, by taking masonry units 128 directly off the line, such as onto shipping pallets.

As seen in FIG. 1, the stations of masonry unit fabrication system 10 can be sequentially configured, which has the potential to be significantly faster and more efficient than a conventional concrete block machine. This assembly line-type production is not uncommon to manufacturing in general, but has not been applied to the manufacture of concrete masonry units or other cast or molded masonry units.

As well, conventional concrete block machines are exceptionally heavy, as are the trays, mold arrays, and presser plates. This is the result of a need to cast multiple blocks at one time, to make up for the inefficiency of the production concept, which by design dictates that all actions take place within a "throat" of the machine.

In contrast to heavy concrete block machines and associated hardware, the masonry unit fabrication system 10 can readily be configured to produce single masonry units 128 continuously along a progressive chain of stations. For this reason, the masonry unit fabrication system 10 and associated components, e.g. individual trays, molds, presser plates, and ancillary components, can be lighter in weight than a conventional concrete block machine. The lighter weight allows for reduced construction costs and greater transportability, which in turn supports a manufacturing protocol in which production operations can be economically set up adjacent to a raw material source, thus reducing transportation expenses and the associated carbon footprint.

As discussed above, the masonry unit fabrication system 10 can also be configured to dynamically compress 312 the feedstock 26 within the block mold 16, in contrast to static compression that is typical of conventional block machines.

Dynamic compression 312, i.e. impact-assisted consolidation 312, has an advantage of increasing the packing density of any given aggregate composition, thereby decreasing pore space, and improving strength and durability. The result is that performance criteria can be achieved at lower cement ratios and less expensive feedstocks, reducing both overall unit costs and carbon footprint.

In some embodiments of the masonry unit fabrication system 10 and associated process 300, the feedstock 26 can be formulated to include recycled and/or waste ingredients, such as to produce masonry building units 128 having a zero carbon footprint and potentially even carbon sequestration.

In the illustrative masonry unit fabrication system 10 seen in FIG. 1, each of several steps in the production process 300 can occur simultaneously: inserting 302 the molds 16, filling and leveling 304 the block molds 16, pressing 308, 310, 312 the feedstock 26 within the block molds 16, finishing 314 the masonry blocks 128, and de-molding 318 the masonry blocks 128.

In contrast to the masonry unit fabrication system 10 disclosed herein, in a conventional concrete block machine, the production stages are restricted to a single location, wherein each production stage is required to wait for previous actions to finish before the next action can begin.

The masonry unit fabrication system 10 and associated process 300 provide significant advantages over conventional concrete production technologies for each stage in the manufacture of concrete masonry units, such as related to de-agglomeration of feedstocks 26, improved molding of masonry blocks 128, improved filling 304, leveling 514, consolidation 308, compression 310,312, finishing 314, demolding 316, and extraction 316 of cell centers 130. Such improvements yield several benefits over conventional techniques, such as improving the speed of production, decreasing energy requirements, decreasing machine manufacturing costs, enabling transportability, improving ease of maintenance, allowing an expanded range of suitable feedstocks 26, and/or improving the quality of manufactured masonry blocks 128, while also providing significant environmental benefits.

In some embodiments of the masonry unit fabrication system 10, upon full de-molding 318, the finished blocks 128 can continue to move down the production corridor 14, where they are allowed to gain an initial set without handling or disturbing. In some embodiments of the masonry unit fabrication system 10, the empty block mold boxes 16 can travel a return loop, to be re-inserted into the production corridor point of entry 12. In contrast to conventional mold boxes, the block molds 16 can readily be configured to be lightweight, inexpensive, and easy to replace.

In addition to the advantages of the sequential production corridor and dynamic compression described above, the masonry unit fabrication system 10 can be configured to offer componentization or compartmentalization. For example, in some system embodiments 10, one or more of the stations can be configured to be ganged together along the production corridor 14. For instance, the filling stations 20, the impact stations 80, the finishing stations 100, and the cell extraction stations 120 can be designed and manufactured in such a way as to gang together along the production corridor 14.

For users who want to produce smaller building units 128, such as veneer bricks, a single filling station 20 and a single impact station 80 can be sufficient in combination with the molding and de-molding components.

On the other hand, users who intend to manufacture full size full height hollow core concrete masonry units 128, or CMU replacements 128, can configure the system 10 to include two or three filling stations 40 and impact stations 80, in addition to the molding, de-molding, and cell extraction components.

Furthermore, those users who desire taller than normal units 128, but without cells 130, can configure the masonry unit fabrication system 10 with more than three filling stations 20 and impact stations 40, 60, 80, but eliminate a cell extraction station 120.

The masonry unit fabrication system 10 can therefore be customized in myriad ways to meet the needs of the user. This is in sharp contrast to conventional concrete block machines that are currently on the market.

In summary, the enhanced masonry unit fabrication system 10 differs from other conventional brick or block making machinery in that the several different actions that account for production can occur simultaneously along a sequential production corridor 14.

The enhanced masonry unit fabrication system 10 allows for lighter construction than conventional masonry production systems, and also provides faster production. Light construction supports transportability and lower cost maintenance. Transportability allows the machine to move to the source of the raw materials, which can reduce production cost and decrease global warming.

The enhanced masonry unit fabrication system 10 can readily be utilized by any of commodity block manufactures, quarry operators, general engineering contractors, and start-up small business owners who understand the enormous global benefits afforded by conversion to sustainable building materials.

Accordingly, although the invention has been described in detail with reference to a particular preferred embodiment, persons possessing ordinary skill in the art to which this invention pertains will appreciate that various modifications and enhancements may be made without departing from the spirit and scope of the disclosed illustrative embodiments.

The invention claimed is:

1. A process, comprising:

de-agglomerating a masonry feedstock having a moisture content associated therewith with a vertical shaft mixer having an upper end and a lower end opposite the upper end, wherein the masonry feedstock is loaded into the vertical shaft mixer, wherein the vertical shaft mixer de-agglomerates the masonry feedstock to produce a compressible de-agglomerated masonry feedstock, and wherein the compressible de-agglomerated masonry feedstock exits the vertical shaft mixer through the lower end;

transferring the compressible de-agglomerated masonry feedstock from the vertical shaft mixer to a supply hopper;

filling an interior region of a masonry block mold with the compressible de-agglomerated masonry feedstock from the supply hopper, wherein at least a portion of the masonry block mold is releasable;

consolidating the compressible de-agglomerated masonry feedstock within the masonry block mold;

dynamically compressing the consolidated compressible de-agglomerated masonry feedstock to form a masonry block having a face;

laterally releasing the masonry block mold from the face of the masonry block;

removing the masonry block from the released masonry block mold;

moving the masonry block to a curing area; and curing the masonry block;

wherein the process is performed at a plurality of sequential stations; and wherein a production corridor is defined between the plurality of sequential stations.

2. The process of claim 1, wherein the masonry feedstock includes an aggregate matrix having any of clay or binder pills, and wherein the de-agglomerating breaks apart the clay or binder pills within the aggregate matrix.

3. The process of claim 1, further comprising:

controllably varying a compaction factor of the filled compressible de-agglomerated masonry feedstock before the consolidating.

4. The process of claim 1, further comprising:

leveling off the filled masonry feedstock within the masonry block mold.

5. The process of claim 1, further comprising:

compressing the consolidated compressible de-agglomerated masonry feedstock within corners of the masonry block mold.

6. The process of claim 1, wherein the dynamically compressing the consolidated feedstock comprises:

simultaneously compressing and applying a high-frequency impact force to the consolidated compressible de-agglomerated feedstock within the masonry block mold.

7. The process of claim 1, further comprising:

adjusting the height of the formed masonry block within the masonry block mold.

8. The process of claim 1, further comprising:

removing a cell center of the formed masonry block within the masonry block mold.

9. The process of claim 1, wherein the masonry block mold includes an insert within the interior region, wherein a feature the masonry block is formed by the insert.

10. The process of claim 1, wherein the plurality of sequential stations include:

a filling station that includes the vertical shaft mixer and the supply hopper;

a consolidation station configured for the consolidating the compressible de-agglomerated masonry feedstock within the masonry block mold;

a dynamic compression station for dynamically compressing the consolidated compressible de-agglomerated masonry feedstock to form the masonry block; and a de-molding station for removing the masonry block from the released masonry block mold.

11. The process of claim 1, wherein the masonry block mold includes any of springs or hinges to release the masonry block mold from the formed masonry block.

12. A system for production of masonry blocks, comprising:

a vertical shaft mixer for de-agglomerating a masonry feedstock having a moisture content associated therewith, wherein the vertical shaft mixer includes an upper end and a lower end opposite the upper end, wherein the vertical shaft mixer is configured to receive the masonry feedstock through the upper end, de-agglomerate the received masonry feedstock to produce a compressible de-agglomerated masonry feedstock, and output the compressible de-agglomerated masonry feedstock through the lower end;

a supply hopper configured to store the compressible de-agglomerated masonry feedstock received from the vertical shaft mixer;

a masonry block mold having an interior defined therein, wherein at least a portion of the masonry block mold is configured to be releasable away from a face of a masonry block formed within the interior;

a filling mechanism configured for filling the interior region of the masonry block mold with the compressible de-agglomerated masonry feedstock from the supply hopper;

a consolidation mechanism configured for consolidating the compressible de-agglomerated masonry feedstock within the masonry block mold; and a dynamic compression mechanism configured for dynamically compressing the consolidated compressible de-agglomerated masonry feedstock to form a masonry block;

wherein the formed masonry block is removable from the masonry block mold when the masonry block mold is in a released position;

wherein the system is configured as a plurality of sequential stations; and wherein a production corridor is defined between the plurality of sequential stations.

13. The system of claim 12, wherein the masonry feedstock includes an aggregate matrix having any of clay or binder pills, and wherein the vertical shaft mixer is configured to break apart the clay or binder pills within the aggregate matrix.

14. The system of claim 12, further comprising:

a mechanism for controllably varying a compaction factor of the filled compressible de-agglomerated masonry feedstock before the consolidation.

15. The system of claim 12, further comprising:

a leveling mechanism configured to level off the filled compressible de-agglomerated masonry feedstock within the masonry block mold.

16. The system of claim 12, further comprising:

a compression mechanism for compressing corners of the consolidated compressible de-agglomerated masonry feedstock within the masonry block mold.

17. The system of claim 12, wherein the dynamic compression mechanism is configured to simultaneously compress and apply a high-frequency impact force to the consolidated compressible de-agglomerated feedstock within the masonry block mold.

18. The system of claim 12, further comprising:

a finishing mechanism configured to act upon a top surface of the formed masonry block within the masonry block mold.

19. The system of claim 12, further comprising:

a cell center removal mechanism configured for removing a cell center of the formed masonry block within the masonry block mold.

20. The system of claim 12, wherein the masonry block mold includes an insert within the interior region, wherein the insert is configured to form a feature of the masonry block.

21. The system of claim 12, wherein the vertical shaft mixer is configured to maximize distribution of small particle constituents within the aggregate matrix.

22. The system of claim 12, further comprising:

a mechanism for moving the masonry block mold through the production corridor between the plurality of sequential stations.

23. The system of claim 12, wherein the masonry block mold includes any of springs or hinges that are configured to release the masonry block mold from the formed masonry block.

24. An apparatus for fabricating masonry units, comprising:

a block mold body having an interior defined therein, wherein the block mold body is configured to be moved through a production corridor between a plurality of sequential stations, including a filling station that includes a vertical shaft mixer and a supply hopper;

wherein the vertical shaft mixer is configured to de-agglomerate a masonry feedstock having a moisture content associated therewith, wherein the vertical shaft mixer includes an upper end and a lower end opposite the upper end, wherein the vertical shaft mixer is configured to receive the masonry feedstock through the upper end, de-agglomerate the received masonry feedstock to produce a compressible de-agglomerated masonry feedstock, and output the compressible de-agglomerated masonry feedstock through the lower end; and wherein the supply hopper configured to store the compressible de-agglomerated masonry feedstock received from the vertical shaft mixer;

wherein the block mold body is configured to be filled with the compressible de-agglomerated masonry feedstock from the supply hopper;

wherein the block mold body is further configured to allow compression of the filled compressible de-agglomerated masonry feedstock to form a masonry unit having a face; and a release mechanism configured to release the block mold body away from the face of the formed masonry unit.

25. The apparatus of claim 24, wherein the release mechanism includes any of a hinge or a spring.

26. The apparatus of claim 24, wherein the release mechanism is configured to preserve a cosmetic character of the formed masonry unit.

27. The apparatus of claim 24, wherein the release mechanism is configured to preserve a cosmetic character of the formed masonry unit.

28. The apparatus of claim 24, further comprising:

an insert that is configured to be located within the interior region, wherein the insert is configured to form a feature of the masonry unit.

29. The apparatus of claim 28, wherein the insert is configured for any of embossing, de-bossing, a signature, a brand, a random pattern, a geometric pattern, a rough finish, or a smooth finish.

30. The apparatus of claim 24, wherein distribution of small particle constituents is maximized within the compressible de-agglomerated masonry feedstock.

31. The apparatus of claim 24, wherein the production corridor defines a continuous chamber between at least two of the plurality of sequential stations, and includes a bottom and parallel opposing sides.

32. The apparatus of claim 31, wherein the continuous chamber includes a movable belt, wherein the apparatus is configured to be moved through the production corridor by the movable belt.

33. The system of claim 12, wherein the production corridor defines a continuous chamber between at least two of the plurality of sequential stations, and includes a bottom and parallel opposing sides.

34. The system of claim 33, wherein the continuous chamber includes a movable belt, wherein the masonry block mold is configured to be moved through the production corridor by the movable belt.

* * * * *